US007369785B2

(12) United States Patent
Imayoshi et al.

(10) Patent No.: US 7,369,785 B2
(45) Date of Patent: May 6, 2008

(54) IMAGE FORMING APPARATUS CAPABLE OF FORMING AT LEAST ONE INPUT IMAGE ON AT LEAST ONE SHEET SURFACE AND ALSO OF FORMING A SELECTED PRESTORED IMAGE ON AN OTHERWISE BLANK SURFACE OF THE SHEET

(75) Inventors: Kenichiro Imayoshi, Souraku-gun (JP); Koji Yakushiji, Souraku-gun (JP); Hidemi Sakata, Ikoma-gun (JP); Masako Shinozuka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 163 days.

(21) Appl. No.: 11/080,826

(22) Filed: Mar. 14, 2005

(65) Prior Publication Data

US 2005/0207767 A1 Sep. 22, 2005

(30) Foreign Application Priority Data

Mar. 19, 2004 (JP) ..... 2004-081298

(51) Int. Cl.
*G03G 15/00* (2006.01)

(52) U.S. Cl. ..... 399/45; 399/80; 399/82

(58) Field of Classification Search ..... 399/45, 399/6, 194, 61, 80, 81
See application file for complete search history.

(56) References Cited

U.S. PATENT DOCUMENTS 5,194,945 A * 3/1993 Kadowaki et al. ..... 358/520
5,999,766 A * 12/1999 Hisatomi et al. ..... 399/80
6,782,217 B1 * 8/2004 Ando ..... 399/80
6,785,488 B2 * 8/2004 Katsuyama ..... 399/84
2003/0016959 A1 * 1/2003 Fujikura et al. ..... 399/45
2003/0053117 A1 * 3/2003 Payne et al. ..... 399/61

FOREIGN PATENT DOCUMENTS

| | | |
|---|---|---|
| JP | 01-129652 | 5/1989 |
| JP | 04-183064 | 6/1992 |
| JP | 08-167993 | 6/1996 |
| JP | 10-271318 | 10/1998 |
| JP | 2000-307857 | 11/2000 |

OTHER PUBLICATIONS

Machine Translation and Abstract of JP08167993.*

* cited by examiner

*Primary Examiner*—David M. Gray
*Assistant Examiner*—Ryan D. Walsh
(74) *Attorney, Agent, or Firm*—David G. Conlin; David A. Tucker; Edwards Angell Palmer & Dodge LLP

(57) ABSTRACT

At forming an image only on one side of a sheet, an image forming unit is controlled by a control unit to form a back-side pattern image on the back side of the sheet. At forming images on both sides of sheets, when a blank side where no image is formed exists, similarly, the back-side pattern image is formed on the blank side. In single-sided printing, a back-side pattern image is formed on the back side of the sheet. In double-sided printing, a predetermined image is formed on a blank page and thus no blank page occurs. It is therefore possible to prevent the back side of a sheet on which an important document is printed from being used for other purpose, and consequently security is enhanced.

2 Claims, 7 Drawing Sheets

IMAGE FORMING APPARATUS CAPABLE OF FORMING AT LEAST ONE INPUT IMAGE ON AT LEAST ONE SHEET SURFACE AND ALSO OF FORMING A SELECTED PRESTORED IMAGE ON AN OTHERWISE BLANK SURFACE OF THE SHEET

CROSS-REFERENCE TO RELATED APPLICATION

This non-provisional application claims priority under 35 U.S.C. §119(a) on Patent Applications No. 2004-81298 filed in Japan on Mar. 19, 2004, the entire contents of which are hereby incorporated by reference.

BACKGROUND OF THE INVENTION

1. Field of the Invention

The present invention relates to an image forming apparatus and an image forming system, including an image forming unit for forming an image on one or both sides of a sheet.

2. Description of Related Art

In image forming apparatuses for forming images on sheets, such as printers, copy machines or multi function printers, some image forming apparatus can restrict printing or copying of highly confidential or important documents. For example, an image forming apparatus which prohibits operations such as copying the front side of a sheet if a specific pattern is printed on the back side thereof has been put into practical use (see, for example, Japanese Patent Application Laid-Open No. 2000-307857). For example, by transmitting an instruction (hereinafter referred to as a confidential document instruction) indicating the data of a confidential document or a confidential document from a personal computer connected to an image forming apparatus, a specific pattern as mentioned above is printed on the back side of the sheet on which the confidential document is printed.

Only when a special operation such as transmission of a confidential document instruction is performed in printing a highly confidential or important document (hereinafter referred to as an important document), a specific pattern as mentioned above is formed on the back side of a sheet. Hence, a specific pattern is not necessarily always printed on the back side of an important document. Moreover, as the important documents, there are documents created within a company and documents received from outside the company. There is a low possibility that important documents received from outside the company has a specific pattern printed on the back side thereof, and a specific pattern is not necessarily always printed on the back side of important documents created within the company. Thus, there is a high possibility that the back side of many of important documents is blank.

In general, paper (PPC paper) is used as sheets. Therefore, for the purpose of effectively using resources, it is recommended to use the back side of sheets printed only on one side. However, in terms of security, it is of course not preferred to use the back side of important documents as paper for printing other document or as memo paper. However, we cannot deny the possibility that the back side of sheets on which an important document is printed may be used by mistake as memo paper, or printing paper for other document.

BRIEF SUMMARY OF THE INVENTION

The present invention has been made with the aim of solving the above problems, and it is an object of the present invention to provide an image forming apparatus and an image forming system capable of forming a predetermined image on the back side when forming an image only on one side of a sheet so as to prevent the blank back side of a sheet on which an important document is printed from being used as memo paper, print paper for other document, etc. by mistake, thereby enhancing security.

Another object of the present invention is to provide an image forming apparatus and an image forming system capable of forming a predetermined image on a blank side if the blank side where no image is formed exists when forming images on both sides of one or a plurality of sheets so as to prevent the blank back side of a sheet on which an important document is printed from being used as memo paper, print paper for other document, etc. by mistake, thereby enhancing security.

Still another object of the present invention is to provide an image forming apparatus and an image forming system capable of changing the density of the predetermined image to be formed, and thereby capable of reducing the consumption of toner or ink when the density of the predetermined image to be formed is lowered.

Yet another object of the present invention is to provide an image forming apparatus and an image forming system capable of forming the predetermined image by using a toner or ink with the largest remaining amount among toners or inks of a plurality of colors, thereby equalizing and reducing the consumption of respective toners or inks of a plurality of colors.

A further object of the present invention is to provide an image forming apparatus and an image forming system capable of clearly indicating by letters prohibition of using the back side of an important document by including letters in the predetermined image, thereby enhancing security.

A further object of the present invention is to provide an image forming apparatus and an image forming system capable of preventing the predetermined image formed on the back side from being seen through the front side by forming a mirror image of a part of the image or the entire image formed on one side (front side) of a sheet as the predetermined image on the back side of the sheet.

A further object of the present invention is to provide an image forming apparatus and an image forming system capable of switching a setting whether or not to form the predetermined image on the back side of a sheet, and thereby capable of switching the setting whether or not to form the predetermined image on the back side of a sheet, according to a destination to which an important document is to be distributed.

A further object of the present invention is to provide an image forming apparatus and an image forming system which receive an instruction for setting whether or not to form the predetermined image on the back side of a sheet from outside, and switch the setting whether or not to form the predetermined image, according to the received result, and thereby allowing a user to choose whether or not to form the predetermined image on the back side of a sheet.

A further object of the present invention is to provide an image forming apparatus and an image forming system which receive an instruction for setting whether or not to form the predetermined image on the back side of a sheet from outside for each unit of processes of image formation including one or a plurality of images, and thereby allowing a user to choose whether or not to form the predetermined image on the back side of a sheet for each unit of processes of image formation.

A further object of the present invention is to provide an image forming apparatus and an image forming system which receive an instruction specifying an image in each unit of processes of image formation including one image or a plurality of images from outside so as to perform formation of the predetermined image on the back side of a sheet for the specified image, and thereby allowing a user to specify an image portion or a sheet (page) where the predetermined image should be formed.

A further object of the present invention is to provide an image forming apparatus and an image forming system capable of automatically switching the setting whether or not to form the predetermined image on the back side of a sheet, according to a sheet type, and thereby preventing the predetermined image from being formed on a sheet whose back side cannot be used or a sheet with the back-side on which unnecessary information should not be formed, such as OHP sheets or post cards, for example.

A further object of the present invention is to provide an image forming apparatus and an image forming system capable of automatically switching the setting whether or not to form the predetermined image, according to whether the image contains predetermined identification information, thereby improving the convenience of the user and preventing the user from making a switching mistake.

A further object of the present invention is to provide an image forming apparatus and an image forming system capable of automatically switching the setting whether or not to form the predetermined image on the back side of a sheet, according to an authentication result, and thereby capable of certainly forming the predetermined image on the back side of a sheet on which an important document which requires authentication for printing is printed.

A further object of the present invention is to provide an image forming apparatus and an image forming system capable of allowing the predetermined image from being selected from a plurality of types of images by preparing a plurality of types of images for the predetermined image beforehand.

A further object of the present invention is to provide an image forming apparatus and an image forming system capable of using any one of the prepared images as the predetermined image, and thereby capable of changing the type of the predetermined image to be formed on the back side of a sheet, according to the content of an important document printed on the front side of the sheet, a destination to which the important document is to be sent, or other factor.

A further object of the present invention is to provide an image forming apparatus and an image forming system capable of forming the predetermined image on the almost entire surface of the back side of a sheet so as to certainly prevent the back side of an important document from being used by mistake, thereby enhancing security.

A further object of the present invention is to provide an image forming apparatus and an image forming system capable of easily preparing an arbitrary image as the predetermined image by using an image read by an image reading apparatus as the predetermined image.

A further object of the present invention is to provide an image forming apparatus and an image forming system capable of easily preparing an arbitrary image as a predetermined image to be formed on the back side of a sheet by creating the predetermined image with an information processing apparatus such as a personal computer.

A further object of the present invention is to provide an image forming apparatus and an image forming system capable of automatically switching the setting whether or not to form the predetermined image on the back side of a sheet, according to a sender of image data, thereby improving the convenience of the user who sends image data and preventing the user from making a switching mistake.

A further object of the present invention is to provide an image forming apparatus and an image forming system capable of automatically forming an image associated with a sender of image data as the predetermined image on the back side of a sheet, thereby improving the convenience of the user.

An image forming apparatus according to a first aspect of the invention comprises an image forming unit for forming an image on one or both sides of a sheet, and is characterized in that, when forming an image only on one side of a sheet, the image forming unit forms a predetermined image on a back side of the sheet.

In this aspect of the invention, when forming an image only on one side of a sheet, the image forming unit also forms a predetermined image on the back side of the sheet. In normal single-sided printing, since the back side of a sheet after printed is blank, it is possible to use the back side as memo paper or print paper for other document. However, in the present invention, since the predetermined image is formed on the back side of a sheet, it is impossible to use the back side.

Thus, according to the present invention, it is possible to prevent the back side of a sheet on which an important document is printed from being used by mistake, thereby enhancing security.

An image forming apparatus according to a second aspect of the invention comprises an image forming unit for forming an image on one or both sides of a sheet, and is characterized in that, when a blank side where no image is formed exists at forming images on both sides of sheets, the image forming unit forms a predetermined image on the blank side.

In this aspect of the invention, when a blank side where no image is formed exists at forming images on both sides of one or a plurality of sheets, that is, at performing double-sided printing, a predetermined image is formed on the blank side. In double-sided printing, a blank page may exist in the pages to be printed, or the last page may be a blank page. However, in the present invention, since a predetermined image is formed on a blank page (blank side), a blank page (blank side) will not occur even when double-sided printing is performed.

Thus, according to the present invention, since a blank page (blank side) will not occur even when double-sided printing is performed, it is impossible to reuse the back side of a sheet on which an important document is printed, thereby enhancing security.

An image forming apparatus according to a third aspect of the invention is based on the image forming apparatus of the first or second aspect of the invention, and is characterized in that the image forming unit is capable of changing a density of the predetermined image to be formed.

In this aspect of the invention, since the density of the predetermined image to be formed on the back side of a sheet is changeable, it is possible, for example, to set the density of the predetermined image formed on the back side of a sheet to be lighter than that of an image of an important document formed on the front side.

Thus, according to the present invention, it is possible to reduce the consumption of toner or ink for forming the predetermined image on the back side of a sheet. Moreover, if the density of the predetermined image formed on the back side of a sheet is light, the predetermined image does not affect the printed state of the important document on the front side.

An image forming apparatus according to a fourth aspect of the invention is based on the image forming apparatus of the first or second aspect, and is characterized by further comprising a remaining amount detector for detecting a remaining amount of each of toners or inks of a plurality of colors used for image forming by the image forming unit, wherein the image forming unit forms the predetermined image by using the toner or ink of the largest remaining amount detected by the remaining amount detector.

In this aspect of the invention, the remaining amount of each of toners or inks of a plurality of colors is detected, and the predetermined image is formed on the back side of a sheet by using the toner or ink of the largest remaining amount.

Thus, according to the present invention, the consumption ratio of respective toners or inks of a plurality of colors is equalized, and it is possible to reduce the situation of running out of toner or ink. Although the consumption ratio of respective toners or inks of a plurality of colors differs from each other, in general, a lot of apparatuses require replacement of toners or inks of all colors as a cartridge even when toner or ink of any one color was consumed. In the present invention, however, since the predetermined image is formed on the back side of a sheet by using the toner or ink of the largest remaining amount, it is possible to extend the life of the toner cartridge or ink cartridge as a whole and expect the effect of reducing costs.

An image forming apparatus according to a fifth aspect of the invention is based on the image forming apparatus of the first or second aspect, and is characterized in that the predetermined image includes letters.

In this aspect of the invention, the predetermined image to be formed on the back side of a sheet includes letters. It is therefore possible to form letters such as "Using the back side is prohibited", for example, as the predetermined image.

Thus, according to the present invention, the meaning of forming the predetermined image on the back side of a sheet, for example, prohibiting using the back side of a sheet on which an important document is printed, can be clearly indicated by letters, thereby further enhancing security.

An image forming apparatus according to a sixth aspect of the invention is based on the image forming apparatus of the first or second aspect, and is characterized in that the predetermined image is a mirror image of a part of or the entire image formed on one side of the sheet.

In this aspect of the invention, since the predetermined image to be formed on the back side of a sheet is a mirror image of a part of the image or the entire image formed on the front side of the same sheet, the predetermined image formed on the back side of the sheet perfectly overlaps the image on the front side. Specifically, it may be possible to form a mirror image, such an image created by reversing the left and right sides of a part of the image or the entire image formed on the front side of a sheet, on the back side of the same sheet, or it may be possible to prepare an additional image to be added to the front side of a sheet and a mirror image of the additional image beforehand so that the additional image is formed on a predetermined position of the front side of a sheet and the mirror image is formed on the corresponding position of the back side of the sheet.

Thus, according to the present invention, since the predetermined image is formed on the back side of a sheet so that it overlaps the image on the front side of the same sheet, it is possible to prevent the predetermined image formed on the back side of the sheet from being seen through the front side.

An image forming apparatus according to a seventh aspect of the invention is based on the image forming apparatus of the first or second aspect, and is characterized by further comprising a switching mechanism for switching a setting whether or not to form the predetermined image.

In this aspect of the invention, since the setting whether or not to form the predetermined image on the back side of a sheet can be switched, it is possible to switch the setting to form the predetermined image on the back side of sheets on which an important document to be distributed, for example, within a company is printed, and not form the predetermined image on the back side of sheets on which an important document to be distributed, for example, outside the company is printed.

Thus, according to the present invention, the setting whether or not to form the predetermined image on the back side of a sheet on which an important document is printed can be switched according to a destination to which the important document is to be distributed, thereby improving convenience.

An image forming apparatus according to an eighth aspect of the invention is based on the image forming apparatus of the seventh aspect, and is characterized by further comprising an instruction receiving unit for receiving an instruction for setting whether or not to form the predetermined image, wherein the switching mechanism switches the setting whether or not to form the predetermined image, according to a received result by the instruction receiving unit.

In this aspect of the invention, an instruction whether or not to form the a predetermined image on the back side of a sheet is received from outside, more specifically, an instruction from the user is received, and the setting whether or not to form the predetermined image on the back side of a sheet is switched according to the received result. Therefore, for example, a user who gave an instruction to print a document on the front side of a sheet can simultaneously instruct by himself/herself whether or not to form the predetermined image on the back side of the sheet. For instance, the setting whether or not to form the predetermined image on the back side of a sheet may also be initially set when installing the image forming apparatus.

Thus, according to the present invention, the user who gave an instruction to form an image on the front side of a sheet can choose by himself/herself whether or not to form the predetermined image on the back side of the sheet, thereby improving convenience.

An image forming apparatus according to a ninth aspect of the invention is based on the image forming apparatus of the eighth aspect, and is characterized in that the instruction receiving unit receives an instruction for setting whether or not to form the predetermined image for each unit of processes of image formation including one image or a plurality of images.

In this aspect of the invention, for each unit of processes of image formation including one image or a plurality of images, an instruction for setting whether or not to form the predetermined image on the back side of a sheet is received from outside. Therefore, for example, every time an instruction to print a document on the front side of a sheet is received from a user, it is possible to simultaneously receive an instruction setting whether or not to form the predetermined image on the back side of the sheet.

Thus, according to the present invention, every time a user gives an instruction to form an image on the front side of a sheet, the user can choose by himself/herself whether or not to form the predetermined image on the back side of the sheet, thereby improving convenience.

An image forming apparatus according to a tenth aspect of the invention is based on the image forming apparatus of the eighth aspect, and is characterized in that the instruction receiving unit receives an instruction for specifying an image in each unit of processes of image formation including one image or a plurality of images so as to form the predetermined image on the back side of a sheet on which the specified image is formed.

In this aspect of the invention, the image forming apparatus can receive an instruction specifying an image in each unit of processes of image formation including one or a plurality of image from outside so as to form the predetermined image corresponding to the specified image. Accordingly, for example, when receiving an instruction to print a document on the front side of a sheet from a user, it is possible to simultaneously receive from the user an instruction specifying an image portion or a page for which the predetermined image should be formed.

Thus, according to the present invention, the user can specify an image portion or a page for which the predetermined image should be formed, thereby improving convenience. Moreover, when forming a predetermined image, since it is necessary to perform image formation on both sides of a sheet, the processing speed of image formation can be improved by specifying a portion where the predetermined image should be formed.

An image forming apparatus according to an eleventh aspect of the invention is based on the image forming apparatus of the seventh aspect, and is characterized by further comprising a sheet type judging unit for judging sheet type, wherein the switching mechanism switches the setting whether or not to form the predetermined image, according to a detection result of the sheet type judging unit.

In this aspect of the invention, the setting whether or not to form the predetermined image is automatically switched according to a result of sheet type judgment. Therefore, for example, if the sheet is an OHP (Over Head Projector) sheet or a post card, formation of the predetermined image on the back side is prohibited.

Thus, according to the present invention, it is possible to automatically prevent formation of the predetermined image on the back side of sheets which will have problems if an image is formed on the back side, such as OHP sheets or post cards.

An image forming apparatus according to a twelfth aspect of the invention is based on the image forming apparatus of the seventh aspect, and is characterized by further comprising an authentication receiving unit for receiving authentication information for authenticating a user, wherein the switching mechanism switches the setting whether or not to form the predetermined image, according to an authentication result of the authentication information received by the authentication receiving unit.

In this aspect of the invention, a judgment is made as to whether or not an image contains predetermined identification information, and then the setting whether or not to form the predetermined image is automatically switched according to the judgment result. For example, the judgment can be made by judging whether letters such as "IMPORTANT" or a predetermined image representing an important document is present by using an OCR (Optical Character Reader).

Thus, according to the present invention, since the user does not need to switch the setting whether or not to form the predetermined image, it is possible to improve the convenience of the user and prevent the user from making a switching mistake.

An image forming apparatus according to a thirteenth aspect of the invention is based on the image forming apparatus of the seventh aspect, and is characterized by further comprising a judging unit for judging whether or not an image contains predetermined identification information, wherein the switching mechanism switches the setting whether or not to form the predetermined image, according to a judgment result of the judging unit.

In this aspect of the invention, the setting whether or not to form the predetermined image is automatically switched according to the authentication result. Therefore, for example, by registering identification information such as the user ID or passwords of users handling important documents in advance, the predetermined image is automatically formed.

Thus, according to the present invention, when a particular user who handles an important document gives an instruction to print a document, it is possible to surely form the predetermined image on the back side of a sheet on which the important document is printed.

An image forming apparatus according to a fourteenth aspect of the invention is based on the image forming apparatus of the first or second aspect, and is characterized by further comprising a storage unit for storing a plurality of types of images for use as the predetermined image, wherein the image forming unit forms any one of the images stored in the storage unit as the predetermined image on the sheet.

In this aspect of the invention, a plurality of types of images for use as the predetermined image are prepared by storing them in advance. It is therefore possible to change an image to be selected as the predetermined image, according to an instruction from the user, the degree of importance, or other factor.

Thus, according to the present invention, since the user can arbitrarily select an image to be used as the predetermined image from a plurality of images, it is possible to flexibly change the predetermined image according to the degree of importance of the important document, or a destination to which the important document is to be distributed, thereby improving convenience.

An image forming apparatus according to a fifteenth aspect of the invention is based on the image forming apparatus of the first or second aspect, and is characterized in that the image forming unit forms the predetermined image on an almost entire surface of the sheet.

In this aspect of the invention, the predetermined image is formed on the almost entire surface of the back side of a sheet. Hence, it is possible to form a plurality of small predetermined images on the entire surface of a sheet, or form one large predetermined image on the entire surface of a sheet.

Thus, according to the present invention, it is possible to surely prevent the back side of a sheet on which an important document is printed from being used by mistake, thereby enhancing security.

An image forming system according to a sixteenth aspect of the invention is characterized by comprising: an image reading apparatus for reading an original document to create image data and sending the created image data; and an image forming apparatus including an image forming unit for forming the image data sent by the image reading apparatus as an image on one or both sides of a sheet, and, when the image is to be formed only on one side of a sheet, forming a predetermined image on a back side of the sheet, wherein the predetermined image is an image read by the image reading apparatus.

Also, an image forming system according to a seventeenth aspect of the invention is characterized by comprising an image reading apparatus for reading an original document to create image data and sending the created image data; and an image forming apparatus including an image forming unit for forming the image data sent by the image reading apparatus as an image on one or both sides of a sheet, and, when a blank side where no image is formed exists at forming images on both sides of sheets, forming a predetermined image on the blank side.

In such aspects of the inventions, image data sent from the image reading apparatus that reads an original document and creates image data is formed on a sheet by the image forming apparatus. Here, the predetermined image is an image read by the image reading apparatus. For example, the image reading apparatus is an image scanner, and can be integrated with the image forming apparatus.

Thus, according to the present invention, it is possible to easily prepare the predetermined image by reading an arbitrary image with the image reading apparatus.

An image forming system according to an eighteenth aspect of the invention is characterized by comprising: an information processing apparatus for creating image data and sending the created image data; and an image forming apparatus including an image forming unit for forming the image data sent by the information processing apparatus as an image on one or both sides of a sheet, and, when the image is to be formed only on one side of a sheet, forming a predetermined image on a back side of the sheet, wherein the predetermined image is an image created by the information processing apparatus.

Also, an image forming system according to a nineteenth aspect of the invention is characterized by: an information processing apparatus for creating image data and sending the created image data; and an image forming apparatus including an image forming unit for forming the image data sent by the image reading apparatus as an image on one or both sides of a sheet, and, when a blank side where no image is formed exists at forming images on both sides of sheets, forming a predetermined image on the blank side, wherein the predetermined image is an image created by the information processing apparatus.

In such aspects of the invention, image data sent from the information processing apparatus that creates image data is formed on a sheet by the image forming apparatus. Here, the predetermined image is an image created by the information processing apparatus. For example, the information processing apparatus is a personal computer, and connected to the image forming apparatus through a communication line.

Thus, according to the present invention, it is possible to easily prepare the predetermined image by creating an arbitrary image with the information processing apparatus.

An image forming system according to a twentieth aspect of the invention is based on the image forming system of the sixteenth or seventeenth aspect, and is characterized in that the image forming apparatus further comprises: an identifying unit for identifying a sender of image data; and a switching mechanism for switching a setting whether or not to form the predetermined image, according to an identification result of the identifying unit.

In this aspect of the invention, the sender of image data is identified by the image forming apparatus, and the setting whether or not to form the predetermined image is automatically switched according to the identification result. Hence, by storing a setting whether or not to form the predetermined image in the storage unit beforehand according to the senders of image data, the predetermined image will be automatically formed on the back side of the sheet if the identified sender is stored in the storage unit.

Thus, according to the present invention, since a user who sends image data does not need to switch the setting whether or not to form the predetermined image, it is possible to improve the convenience of the user and prevent the user from making a switching mistake.

An image forming system according to a twenty-first aspect of the invention is based on the image forming system of the eighteenth aspect, and is characterized in that the image forming apparatus further comprises a storage unit for storing images associated with senders of image data, wherein the image forming unit reads an image read from the storage unit corresponding to an identification result of the identifying unit on a sheet.

In this aspect of the invention, the storage unit of the image forming apparatus stores images associated with senders of image data, and an image corresponding to an identification result is automatically formed on the back side of a sheet. Therefore, when the corresponding relationship between senders and images is stored in the storage unit beforehand, an image corresponding to a sender is automatically used as the predetermined image based on the corresponding relationship.

Thus, according to the present invention, a user who sends image data does not need to select the predetermined image, thereby improving the convenience of the user.

The above and further objects and features of the invention will more fully be apparent from the following detailed description with accompanying drawings.

DETAILED DESCRIPTION OF THE PREFERRED EMBODIMENTS

The following description will specifically explain the present invention, based on the drawings illustrating preferred embodiments thereof.

Figure 1:
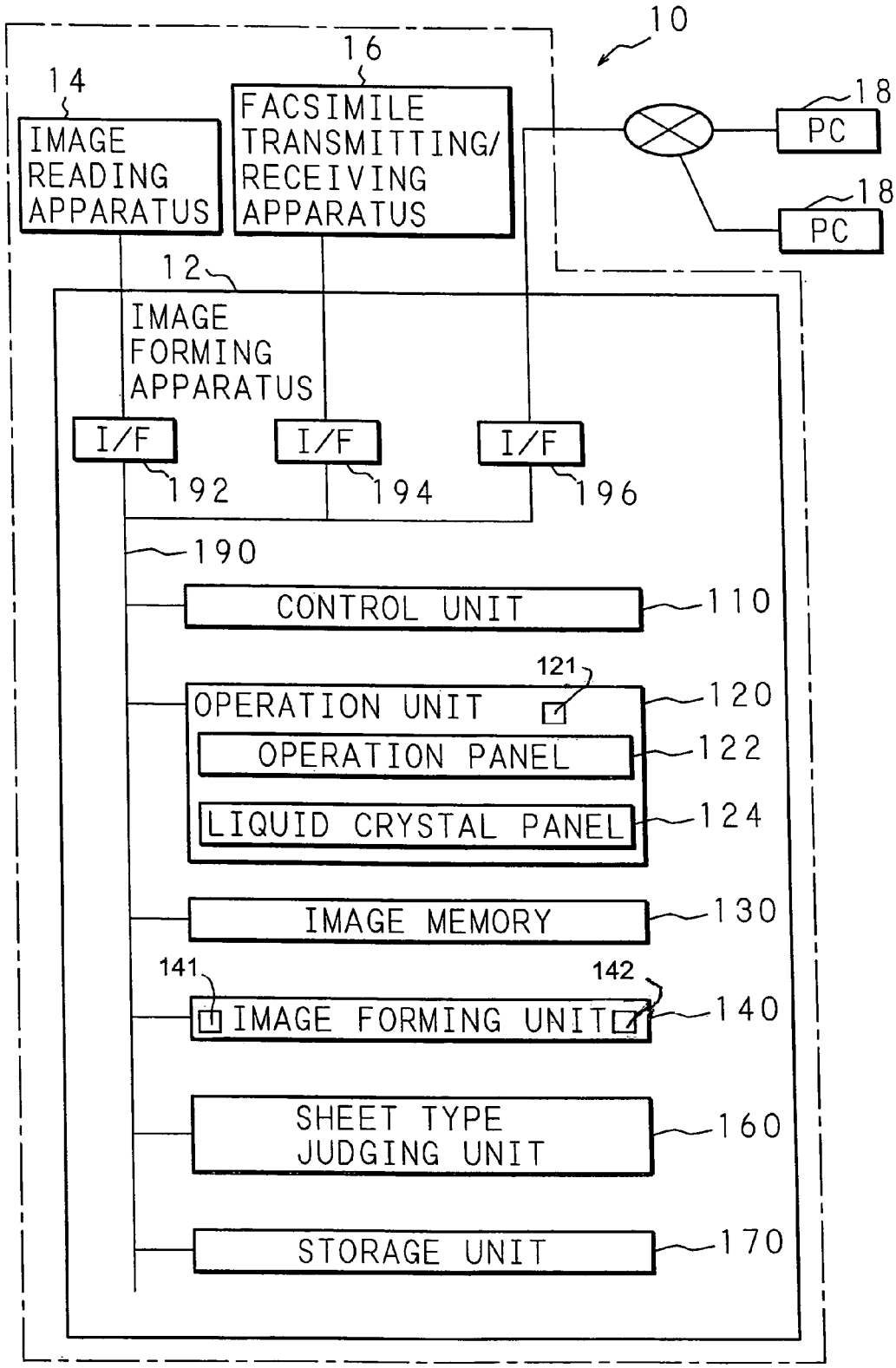
FIG. 1 is a block diagram showing an example of the configuration of an image forming system of the present invention, including a multi function printer comprising an image forming apparatus of the present invention, and a personal computer.

FIG. 1 is a block diagram showing an example of the configuration of an image forming system of the present invention, including a multi function printer 10 comprising an image forming apparatus 12 of the present invention, and personal computers (hereinafter referred to as PCs) 18. The multi function printer 10 includes an image reading apparatus 14 and a facsimile transmitting/receiving apparatus 16 connected to the image forming apparatus 12. Further, at least one, usually a plurality of PCs 18 are connected to the multi function printer 10.

The image forming apparatus 12 comprises an interface unit (hereinafter recited as I/F) 192 to which the image reading apparatus 14 is connected; an I/F 194 to which the facsimile transmitting/receiving apparatus 16 is connected; and an I/F 196 to which the PC 18 as an information processing apparatus is connected, and the respective I/Fs are connected to a bus 190. Although not shown in the drawings, the facsimile transmitting/receiving apparatus 16 is connected to a communication network such as a telephone line. In addition, as later-described, a control unit 110, an operation unit 120, an image memory 130, an image forming unit 140, a sheet type judging unit 160, and a storage unit 170 are connected to the bus 190.

Specifically, the image reading apparatus 14 is a color image scanner designed to output image data obtained by converting a color document into a plurality of color components. The image reading apparatus 14 comprises a CCD (Charge Coupled Device), for example, and is used to read a later-described back-side pattern image as well as the image data of an original document. The image data read by the image reading apparatus 14 is sent to the image forming apparatus 12, and stored in the image memory 130 under the control of the control unit 110.

The facsimile transmitting/receiving apparatus 16 sends an image received as a facsimile to the image forming apparatus 12. The image data sent from the facsimile transmitting/receiving apparatus 16 is stored in the image memory 130 under the control of the control unit 110. The facsimile transmitting/receiving apparatus 16 is also able to send an image received from the image forming apparatus 12 as a facsimile under the control of the control unit 110.

The image forming unit 140 exposes a photosensitive member according to the received image data to form an electrostatic latent image of the image data on the photosensitive member, visualizes the electrostatic latent image by a developer, and transfers the visualized image to a sheet such as recording paper. In order to expose the image data, the image forming unit 140 comprises an LSU (Laser Scanning Unit), for example. The electrostatic latent image formed on the photosensitive member is transferred and fixed to the sheet, and consequently the image is formed (printed). The image forming unit 140 is able to form images on one or both sides of a sheet as described later.

The operation unit 120 comprises an operation panel 122 and a liquid crystal panel 124. The control unit 110 receives operation instructions from the operation panel 122, and displays the processing status, etc. on the liquid crystal panel 124.

The control unit 110 controls the image reading apparatus 14, image forming unit 140, etc. to form an image on a sheet according to an instruction received through the operation unit 120, more specifically the operation panel 122, controls the image forming unit 140, etc. to form an image received by the facsimile transmitting/receiving apparatus 16 on a sheet, or controls the image forming unit 140, etc. to form an image received from a PC 18 on a sheet.

Figure 2:
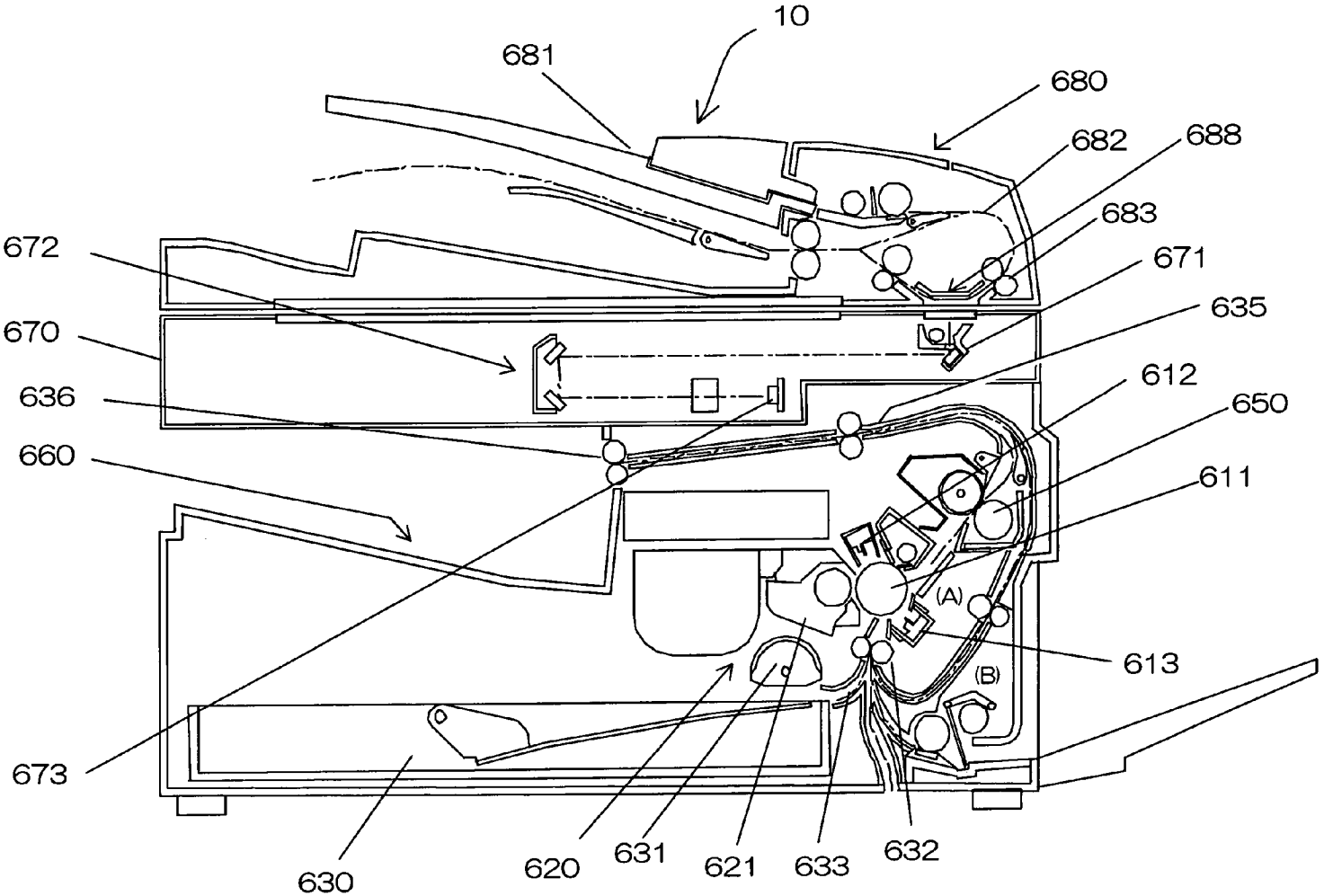
FIG. 2 is a schematic sectional side view showing the detailed configuration of a portion of the multi function printer related mainly to image reading and image formation.

FIG. 2 is a schematic sectional side view showing the detailed configuration of a portion of the multi function printer 10 related mainly to image reading and image formation. The multi function printer 10 comprises a document platen 670 having a transparent glass plate on the upper surface thereof. An optical system for reading an original document is arranged under the document platen 670. The optical system includes an exposure light source 671 for emitting light to an original document placed on the glass plate on the upper surface of the document platen 670; an image forming lens; and a plurality of reflecting mirrors 672 for guiding the light to a photoelectric converting element (CCD) 673.

Further, an ADF (Automatic Document Feeder) 680 for automatically feeding original documents to carry out the operation of reading the original document is mounted on the glass plate on the upper surface of the document platen 670. When original documents are set on a paper feed tray 681, the ADF 680 feeds the original documents one sheet at a time to a paper conveying path 682. The original document fed to the paper conveying path 682 is temporarily stopped with its front end pressed against PS rollers 683. When a clutch (not shown) is turned on (connected), the PS rollers 683 are connected to a driving unit of a conveying motor (not shown), and the conveyance of the temporarily stopped original document is resumed. Consequently, the original document is sent to a document reading window 688.

In a state in which the exposure light source 671 has been moved to just below the document reading window 688, when light is emitted to the original document according to the document conveying start timing, the reflected light from the original document will be guided to the CCD 673 through the above-mentioned respective components of the optical system. The image data of the original document read by the CCD 673 is subjected to image processing, and the LSU 621 emits laser light to the surface of the photosensitive member 611 according to the processing result to form an electrostatic latent image.

The photosensitive member 611 is formed in the shape of a drum, and driven to rotate. A developing device 620 for developing the electrostatic latent image on the surface of the photosensitive member 611 into a visible image by toner is arranged on the periphery of the photosensitive member 611. In addition, arranged on the periphery of the photosensitive member 611 are a transfer charger 613 for transferring the toner image on the surface of the photosensitive member 611 to a sheet; a cleaning device (not shown) for removing the toner remaining on the surface of the photosensitive member 611; a charger 612 for charging the surface of the photosensitive member 611 to a predetermined electric potential; the LSU 621 for emitting laser light to a laser illumination point of the photosensitive member 611, etc.

Sheets (generally PPC sheets) are stored in a sheet cassette 630. A semicircular roller 631 for feeding a sheet to a paper conveying path 633 is arranged in the front end of the sheet cassette 630. Further, arranged along the conveying path from the sheet feeding side to the sheet discharging side are a pre-registration detection switch (not shown) for detecting the passage of a sheet; PS rollers 632 for aligning the positions of the toner image on the photosensitive member 611 and the sheet with each other based on a signal of the pre-registration detection switch; a fixing roller unit 650 for fixing the toner image on the sheet to the sheet by a heat roller and a pressure roller; a fixed paper detection switch (not shown) for detecting the passage of the sheet through the fixing roller unit 650; a paper discharge detection switch (not shown) for detecting the passage of the sheet on a paper discharge path 635; and paper discharging rollers 636 for discharging the sheet. When the sheet is passed through the respective components from the sheet cassette 630 and discharged onto a paper discharge tray 660, a sequence of output (print) processes is completed.

Figures 3A, 3B, 3C:
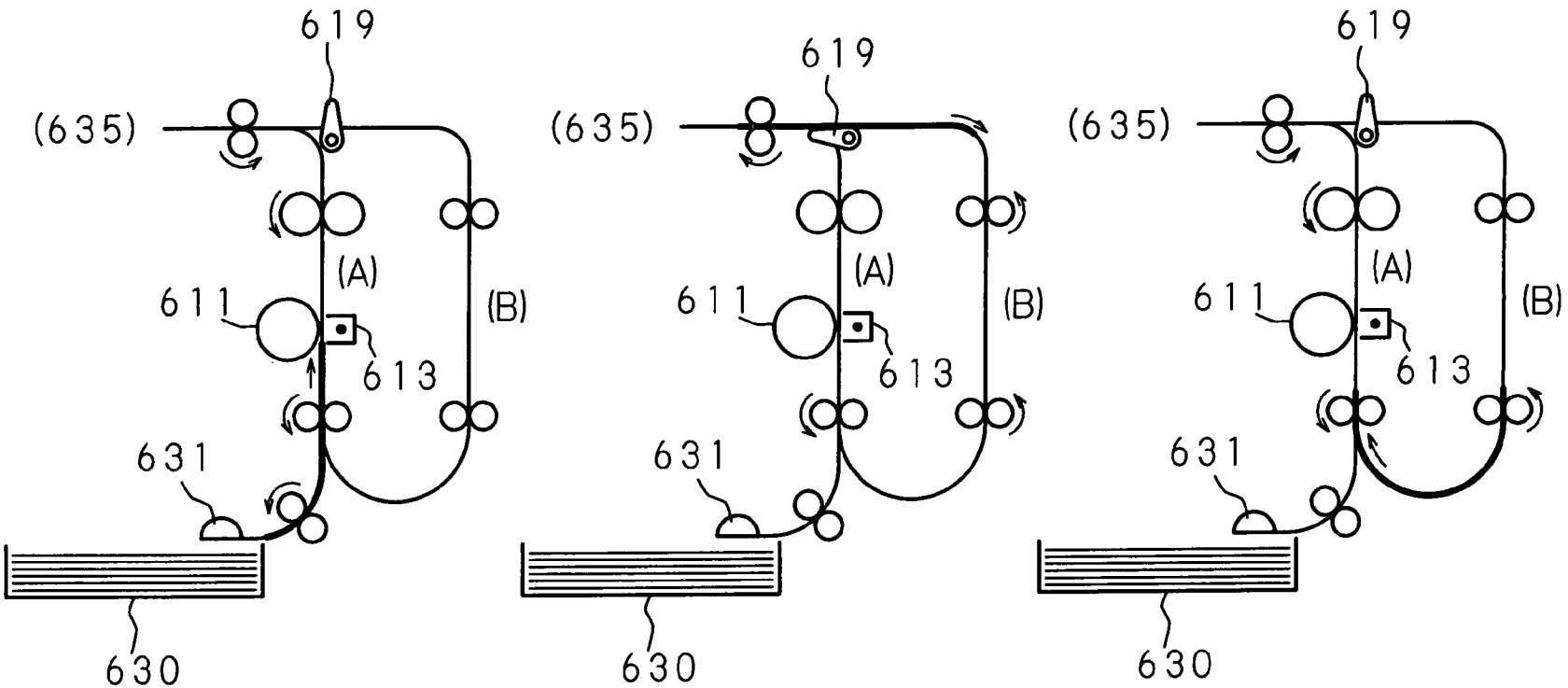
FIG. 3A, FIG. 3B and FIG. 3C are schematic views showing the configuration of the first conveying path and second conveying path and their mutual positional relationship.

A first conveying path running through the photosensitive member 611 and the transfer charger 613, and a second conveying path parallel to the first conveying path are formed between the paper conveying path 633 and the paper discharge path 635. FIG. 3A, FIG. 3B and FIG. 3C are schematic views showing the configuration of the first conveying path (A) and second conveying path (B), and their mutual positional relationship. A guide member 619 closes either the path between the paper discharge path 635 and the first conveying path (A), or the path between the paper discharge path 635 and the second conveying path (B).

In normal single-sided printing, as shown in FIG. 3A, the control unit 110 controls the guide member 619 to close the second conveying path (B) side. In this case, the sheet printed at the photosensitive member 611 is fed to the paper discharge path 635 and discharged onto the paper discharge tray 660.

On the other hand, in double-sided printing, similarly to the above-mentioned single-sided printing, first, printing is performed on one side of a sheet (FIG. 3A) and the sheet is fed to the paper discharge path 635, and then, as shown in FIG. 3B, the first conveying path (A) side is closed by the guide member 619 and the rollers are rotated in the reverse direction temporarily under the control of the control unit 110. Consequently, the sheet is conveyed from the paper discharge path 635 to the second conveying path (B). The sheet conveyed to the second conveying path (B) is fed in the state in which its front and back sides are reversed to the first conveying path (A) again, and printing is performed on the side opposite to the previously printed side. At this time, the guide member 619 is controlled by the control unit 110 to close the second conveying path (B) side. Consequently, the sheet printed on both sides is sent to the paper discharge path 635 and discharged onto the paper discharge tray 660.

When forming an image only on one side of a sheet, the image forming unit 140 forms a back-side pattern image (predetermined image) on the back side of the sheet under the control of the control unit 110. Images to be used as the back-side pattern image is stored in the storage unit 170 beforehand. For example, it is possible to store images read by the image reading apparatus 14, or images created by the PC 18, in the storage unit 170 and then use the image as the back-side pattern image.

The back-side pattern image may be graphics, letters, or a combination of graphics and letters. It is preferable to form the back-side pattern image on the almost entire surface of the back side of a sheet. For example, it is possible to form a plurality of small-size back-side pattern images on the entire surface of the back side of a sheet, and it is possible to form one large-size back-side pattern image on the entire surface of the back side of a sheet. The density of an image to be formed by the image forming unit 140 is changeable by a control operation of the control unit 110. Thus, for example, the density of the back-side pattern image to be formed can be set lighter than that of an image to be formed on the front side (side on which an image is to be formed primarily).

A setting (ON/OFF) whether or not to print a back-side pattern image by the image forming unit 140 can be switched by a control operation of the control unit (switching mechanism) 110. For example, it is possible to receive an instruction for setting whether or not to form a back-side pattern image at the operation unit 120 or I/F 196 (instruction receiving unit), and the setting whether or not to form a back-side pattern image can be switched by the control unit 110 according to the received result. It is possible to receive an instruction for setting whether or not to form a back-side pattern image for each unit of processes of image formation including a single image or a plurality of images, or it is possible to receive an instruction specifying an image or a page in a unit of processes of image formation so that a back-side pattern image is formed for the specified image or page. It may also be possible to store a setting whether or not to form a back-side pattern image as a basic setting in the storage unit 170 when installing the machine.

Moreover, the control unit 110 can identify the sender of image data, etc. The control unit 110 switches the setting whether or not to form a back-side pattern image, according to the identification result. For instance, when printing an image received from a PC 18, the control unit 110 receives the user identification information or apparatus identification information from the PC 18 and confirms whether or not the received identification information is registered in the storage unit 170, and when the identification information is registered, it is possible to form a back-side pattern image. Further, for example, the control unit 110 can receive the user identification information or department identification information from the operation unit 120, and when the received identification information is registered in the storage unit 170, it is possible to form a back-side pattern image. Similarly, for example, the control unit 110 can receive the identification information such as a facsimile number of the sender from the facsimile transmitting/receiving apparatus 16, and when the received identification information is registered in the storage unit 170, it is possible to form a back-side pattern image.

A plurality of types of images for use as a back-side pattern image are stored in the storage unit 170. The control unit 110 forms any one of the images stored in the storage unit 170 as a back-side pattern image on the back side of a sheet. For example, it is possible to store an image associated with the sender of an original document image in the storage unit 170 and then form the image associated with the sender as a back-side pattern image on the back side of a sheet.

A sheet type judging unit 160 for judging sheet type is provided in the sheet cassette 630, and information indicating the judged sheet type is sent to the control unit 110. The control unit 110 switches a setting whether or not to form a back-side pattern image, according to a sheet to be used for printing. For example, when the sheet is an OHP sheet or a post card, formation of a back-side pattern image is not performed.

Figure 4:
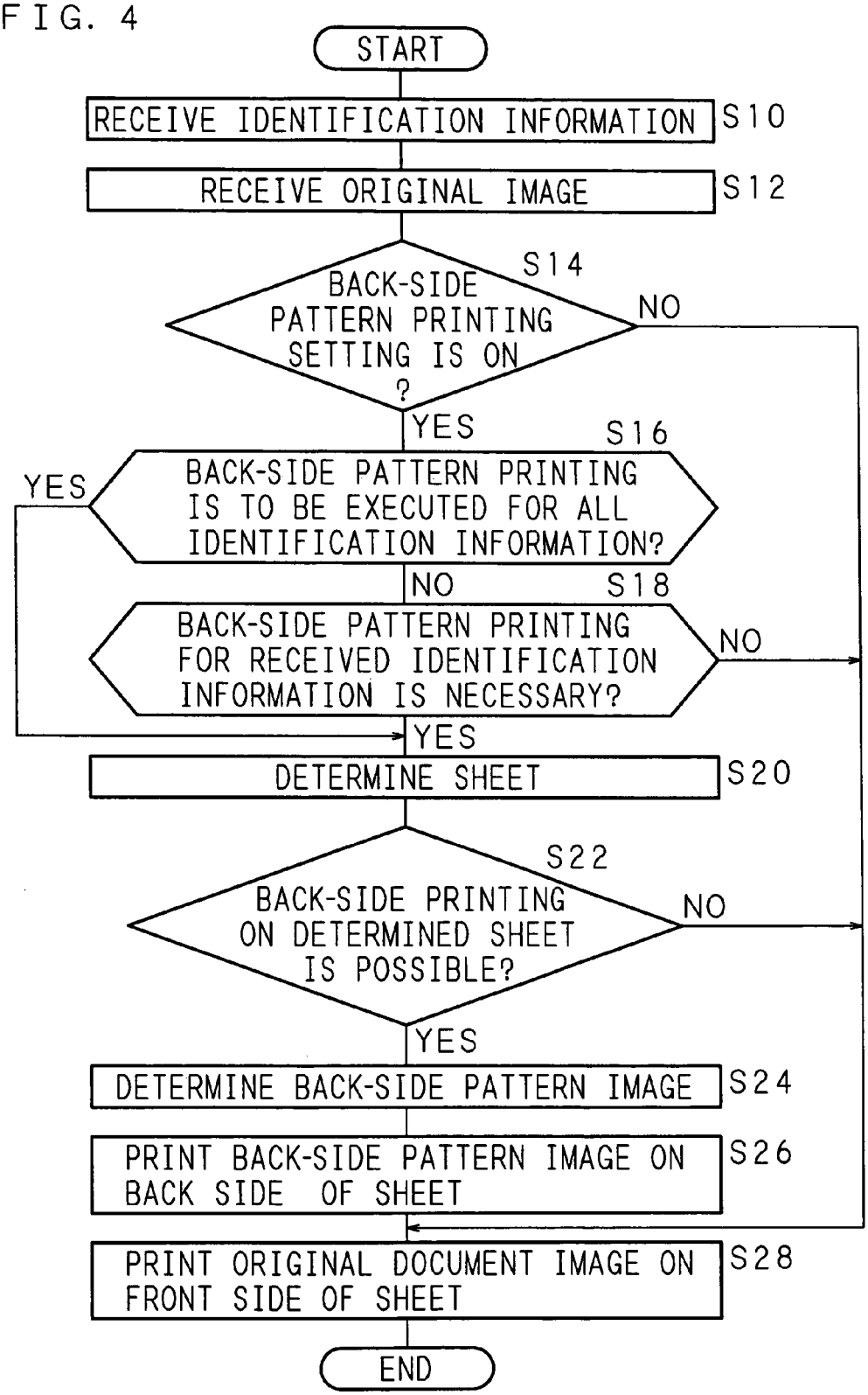
FIG. 4 is a flowchart showing an example of procedure to be performed by a control unit for single-sided printing.
Figure 5A:
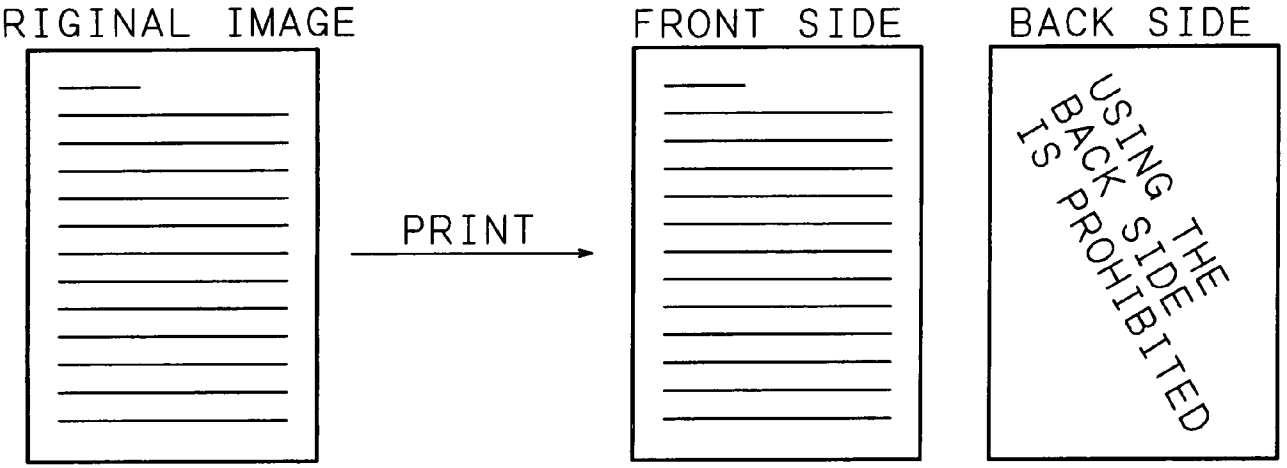
FIG. 5A and FIG. 5B are schematic views showing examples of printing an original document image and a back-side pattern image on a sheet.
Figure 5B:
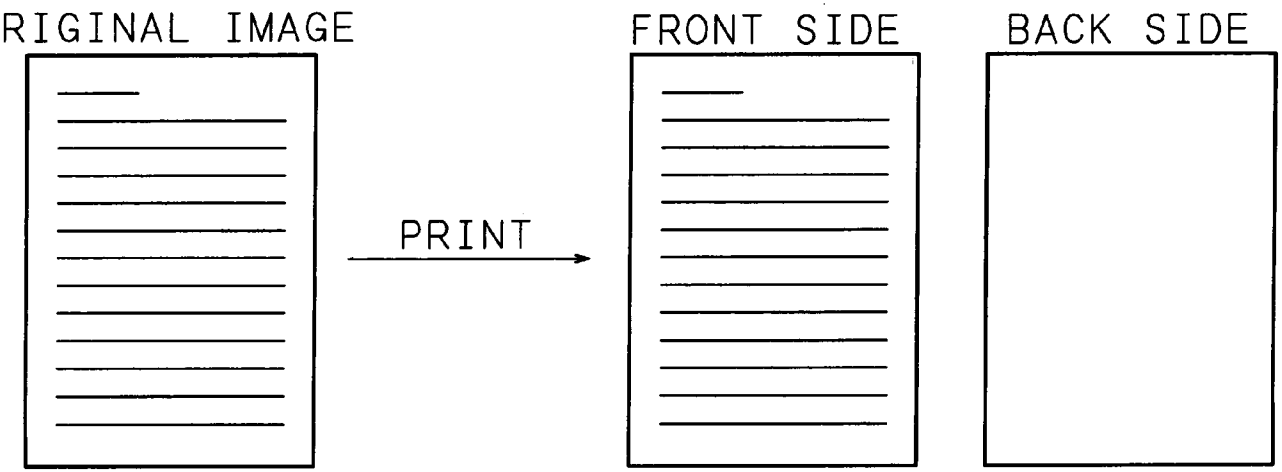

FIG. 4 is a flowchart showing an example of the procedure to be performed by the control unit 110 for single-sided printing. FIG. 5A and FIG. 5B are schematic views showing examples of printing an original document image and a back-side pattern image on a sheet. The control unit 110 receives identification information (S10), receives an original document image (S12), and then confirms, based on the setting information stored in the storage unit 170, whether or not a back-side pattern printing setting is ON (to be printed). Here, when the image forming apparatus 12 operates as a copy machine, for example, reception of the identification information and original document image is carried out by receiving the identification information such as the user ID (authentication information) at authentication receiving unit 121 of the operation unit 120 or a department code at the operation unit 120 and receiving the image data of the original document image from the image reading apparatus 14 at the I/F 192. On the other hand, when the image forming apparatus 12 operates as a printer, the I/F 196 receives the identification information of the user or apparatus and the original document image (image data) from the PC 18. Further, when the image forming apparatus operates as a facsimile machine, the I/F 194 receives the identification information such as the facsimile number of the sender and the original document image (image data) from the facsimile transmitting/receiving apparatus 16.

When the back-side pattern printing setting is ON (S14: YES) and back-side pattern printing is to be executed for all identification information (S16: YES), then the control unit 110 determines a sheet on which back-side printing is to be performed (S20). On the other hand, when the back-side pattern printing setting is ON (S14: YES) but back-side pattern printing is not to be executed for all identification information (S16: NO), then the control unit 110 confirms, based on the registered information stored in the storage unit 170, whether or not it is necessary to perform back-side pattern printing for the received identification information, and, if necessary (S18: YES), determines a sheet on which back-side printing is to be performed (S20).

The control unit 110 confirms whether or not it is possible to actually perform back-side printing on the sheet determined for back-side printing, and if possible (S22: YES), determines a back-side pattern image to be printed (S24). As the back-side pattern image to be printed, it is possible to use a back-side pattern image specified beforehand, or select and use a back-side pattern image corresponding to the received identification information from the back-side pattern images stored in the storage unit 170 beforehand in association with the identification information. The control unit 110 controls the image forming unit 140, etc., and prints the back-side pattern image on the back side of the sheet (S26) and prints the original document image on the front side of the sheet (S28) as shown in FIG. 5A.

On the other hand, when the back-side pattern printing setting is OFF (S14: NO), when it is not necessary to perform back-side printing for the received identification information (S18: NO), or when it is not possible to perform back-side printing on the sheet (S22: NO), then the control unit 110 prints the original document image only on the front side of the sheet as shown in FIG. 5B (S28) in either of these cases.

In the above-described embodiment, it may be possible to omit the switching process for executing or stopping to execute back-side pattern printing based on the identification information (S10, S18), or it may be possible to omit the switching process for executing or stopping to execute back-side pattern printing for all identification information (S16). It may also be possible to omit the process of determining a back-side pattern image (S24), and always use one image stored in the storage unit 170.

In each embodiment described above, although a back-side pattern image stored in the storage unit 170 of the image forming apparatus 12 is formed on the back side of a sheet, it may also be possible to send a back-side pattern image from the PC 18 to the image forming apparatus 12 together with an original document image (image data), and form the sent document image on the front side of a sheet and the sent back-side pattern image on the back side. In this case, the back-side pattern image can be created in a manner similar to the creation of the original document image, and therefore it is possible to flexibly change back-side pattern images. Besides, the image forming apparatus is not limited to a multi-function apparatus, and may be a printer connected to the PC.

Figure 6:
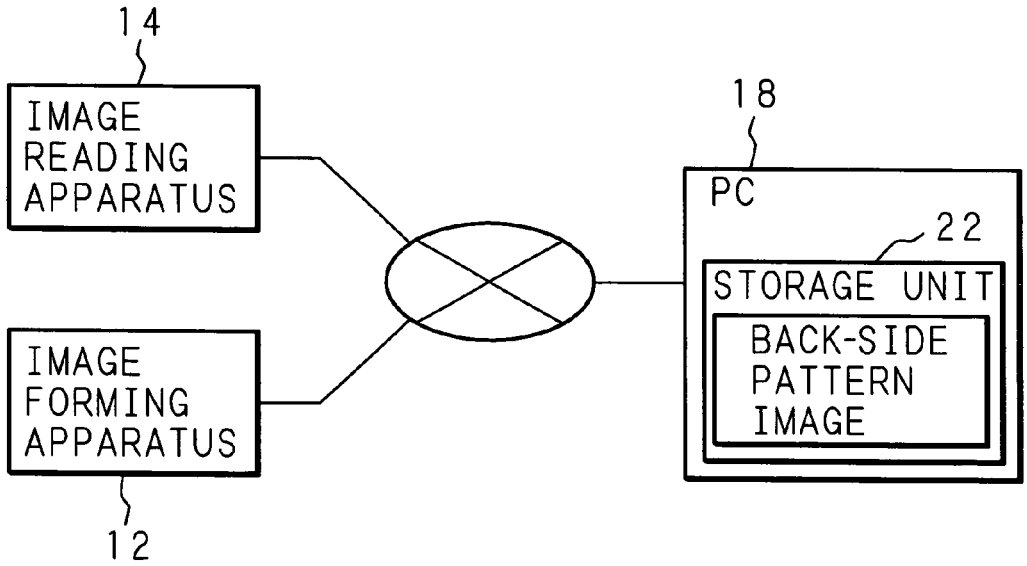
FIG. 6 is a block diagram showing an example of the configuration of an image forming system of the present invention including an image forming apparatus such as a printer, an image reading apparatus such as a network scanner, and a personal computer.

FIG. 6 is a block diagram showing an example of the configuration of an image forming system including an image forming apparatus 12 such as a printer; an image reading apparatus 14 such as a network scanner; and a PC (personal computer) 18. Back-side pattern images are stored in a storage unit 22 such as a hard disk of the PC 18. The PC 18 sends an original document image (image data) and a back-side pattern image to the image forming apparatus 12, and then the image forming apparatus 12 forms the sent original document image on the front side of a sheet and forms the sent back-side pattern image on the back side of the sheet.

In each embodiment described above, when forming an image by using a plurality of types (colors) of toner or ink, it also is possible to control the image forming unit 140 by the control unit 110 to detect the remaining amount of each toner or ink in single/multiple toner or ink container 141 with a remaining amount detector 142 and to form a back-side pattern image by using the toner or ink with the largest remaining amount detected. In this case, since the toner or ink with the largest remaining amount is used for the back-side pattern image, it is possible to equalize the remaining amounts of toners of respective colors, and it is possible to prevent the remaining amount of toner or ink of a particular color from being reduced.

Figure 7:
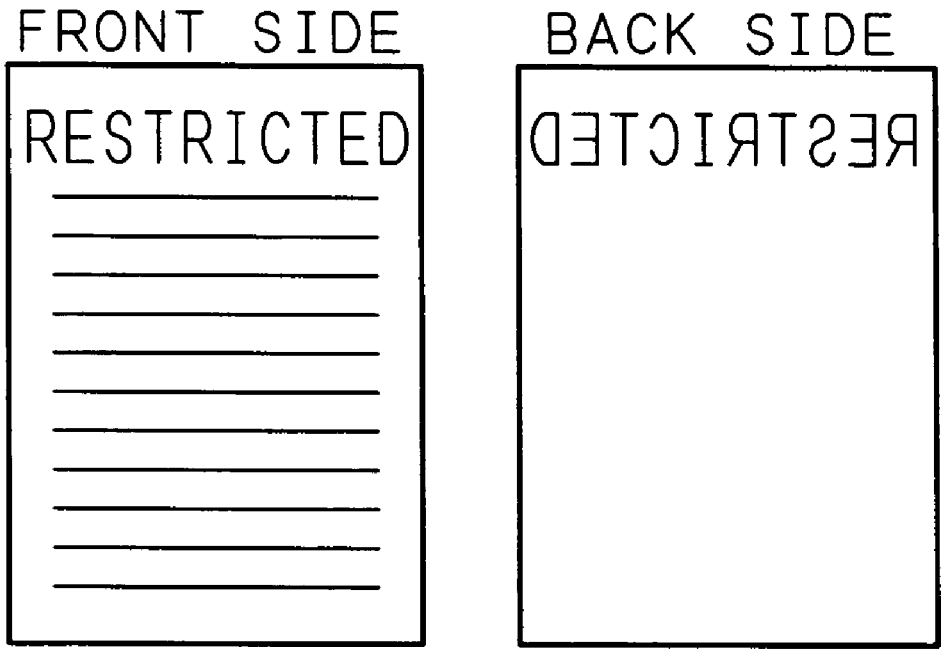
FIG. 7 is a schematic view showing an example of a sheet bearing a back-side pattern image which is a mirror image of a part of the front side.

In each embodiment described above, the back-side pattern image can be a mirror image of a part of the image or the entire image formed on the front side. FIG. 7 is a schematic view showing an example of a sheet bearing a back-side pattern image which is a mirror image of a part of the front side. For example, it may be possible to form a mirror image (back-side pattern image) created by reversing the left and right sides of a part of the image or the entire image on the front side by an image processing circuit, etc. of the image forming unit 140 on the corresponding position of the back side, or it may be possible to store an additional image and a mirror image of the additional image in the storage unit 170 beforehand and then form the additional image on the front side and the mirror image (back-side pattern image) on the corresponding position of the back side. When the mirror image (back-side pattern image) is printed on the back side, the back-side pattern image on the back side of the sheet overlaps the image on the front side, and therefore it is possible to prevent the back-side pattern image formed on the back side from being seen through the front side.

Moreover, in each embodiment described above, it may also be possible to add predetermined identification information to an original document image beforehand, and cause the control unit 110 to judge whether or not an original document image contains the predetermined identification information by using an OCR, etc and to switch the setting whether or not to form a back-side pattern image, according to the judgment result. For example, in the case Where identification information such as predetermined letters or predetermined graphics is added to an important original document image, when the control unit 110 confirms the addition of identification information by an OCR, etc., it is possible to form a back-side pattern image on the back side of a sheet. In this case, for an important original document image, the user does not need to give an instruction to form a back-side pattern image, and a back-side pattern image is automatically formed based on the identification information added to the important original document image.

Further, in each embodiment described above, it may also be possible to add predetermined identification information corresponding to the degree of importance of an original document image in advance, and cause the control unit 110 to identify the identification information added to an original document image by using an OCR, etc. and form a back-side pattern image corresponding to the identified degree of importance. Back-side pattern images corresponding to degrees of importance can be stored in the storage unit 170 beforehand. For instance, it is possible to store a plurality of images and the relationship between the degrees of importance and the respective images in the storage unit 170, and form an image corresponding to the identified degree of importance as a back-side pattern image. In this case, for an important original document image, the user does not need to give an instruction to form a back-side pattern image, and based on the identification information added to the important original document image, a back-side pattern image corresponding to the degree of importance is automatically formed. For instance, it is possible to form a back-side pattern image on a part of the back side when the degree of importance is low, and it is possible to form a back-side pattern image on the entire surface of the back side when the degree of importance is high.

The present invention has been explained by describing single-sided printing as an example, but when images are to be formed on both sides of a sheet, it is possible to cause the control unit 110 to form a back-side pattern image on a blank side where no image is formed. For example, in the case where the control unit 110 performs detection of a blank page, etc. where no image is formed, when a blank page is detected, it is possible to form a back-side pattern image on the blank page. In double-sided printing, there may be a blank page in the pages to be printed, or the last page may be a blank page. In this case, a back-side pattern image is formed on the blank page.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus for forming an image on a front surface of a sheet based on image data inputted from one of a plurality of input sources that communicate therewith, comprising:

an image forming unit for forming an addition image on a back surface of a sheet opposite to a front surface of said sheet on which an image is formed based on said inputted image data;

a storage for previously storing a plurality of pieces of addition image information, each piece of said addition image information being specific to a corresponding one of said plurality of input sources of said inputted image data;

an identification unit for identifying the one of said plurality of said input sources from which said inputted image data on which said image formed on said front surface of said sheet is based is inputted; and a controller for controlling when it is confirmed that specific addition image information corresponding to the one of said plurality of input sources identified by the identification unit is stored in said storage, a reading out from said storage said specific addition image information corresponding to the one of said plurality of input sources identified by said identification unit; and a forming of said addition image based on said specific addition image information on said back surface of said sheet.

2. An image forming apparatus for forming an image on a sheet based on image data inputted from one of a plurality of input sources that communicates therewith, comprising:

a blank surface image forming unit for, when a blank surface where no image is formed would appear while the image forming apparatus is in a both sheet surface image forming mode in which the image forming apparatus allows an image to be formed on each of both a front and a back surfaces of a sheet, forming an addition image on said blank surface;

a storage for previously storing a plurality of pieces of addition image information, each piece of said addition image information being specific to a corresponding one of said plurality of input sources of said inputted image data;

an identification unit for identifying the one of said plurality of said input sources from which said inputted image data on which said image formed on said sheet is based is inputted, and a controller for controlling when it is confirmed that specific addition image information corresponding to the one of said plurality of input sources identified by the identification unit is stored in the storage, a reading out from said storage said specific addition image information corresponding to the one of said plurality of input sources identified by the identification unit; and a forming of said addition image based on said specific addition image information on said blank surface of said sheet.

* * * * *